US010023926B2

(12) United States Patent
Leiva Illanes et al.

(10) Patent No.: US 10,023,926 B2
(45) Date of Patent: Jul. 17, 2018

(54) METHOD FOR THE PRODUCTION OF HIGH-WEAR-RESISTANCE MARTENSITIC CAST STEEL AND STEEL WITH SAID CHARACTERISTICS

(71) Applicant: COMPAÑÍA ELECTRO METALÚRGICA S.A., Santiago (CL)

(72) Inventors: Ricardo Leiva Illanes, Santiago (CL); Raoul Meunier Artigas, Santiago (CL)

(73) Assignee: COMPAÑÍA ELECTRO METALÚRGICA S.A., Santiago (CL)

( * ) Notice: Subject to any disclaimer, the term of this patent is extended or adjusted under 35 U.S.C. 154(b) by 545 days.

(21) Appl. No.: 14/442,897

(22) PCT Filed: Jul. 31, 2013

(86) PCT No.: PCT/CL2013/000049
§ 371 (c)(1),
(2) Date: Aug. 31, 2015

(87) PCT Pub. No.: WO2014/075202
PCT Pub. Date: May 22, 2014

(65) Prior Publication Data

US 2015/0368729 A1 Dec. 24, 2015

(30) Foreign Application Priority Data

Nov. 14, 2012 (CL) ..... 3184-2012

(51) Int. Cl.

| | |
|---|---|
| ***C21D 1/22*** | (2006.01) |
| ***C22C 38/22*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/50*** | (2006.01) |
| ***C22C 38/54*** | (2006.01) |
| ***C21D 6/00*** | (2006.01) |
| ***C22C 38/48*** | (2006.01) |

(52) U.S. Cl.
CPC ..... *C21D 1/22* (2013.01); *C21D 6/004* (2013.01); *C22C 38/001* (2013.01); *C22C 38/02* (2013.01); *C22C 38/04* (2013.01); *C22C 38/06* (2013.01); *C22C 38/22* (2013.01); *C22C 38/42* (2013.01); *C22C 38/44* (2013.01); *C22C 38/48* (2013.01); *C22C 38/50* (2013.01); *C22C 38/54* (2013.01); *C21D 2211/008* (2013.01)

(58) Field of Classification Search
CPC ..... C21D 1/22; C21D 6/004
See application file for complete search history.

(56) References Cited

FOREIGN PATENT DOCUMENTS

| | | | | |
|---|---|---|---|---|
| EP | 0330752 A1 * | 9/1989 | ..... | B23D 61/185 |
| GB | 1 450 355 A * | 9/1976 | ..... | C21D 9/04 |

* cited by examiner

*Primary Examiner* — Jessee Roe
(74) *Attorney, Agent, or Firm* — Birch, Stewart, Kolasch & Birch, LLP

(57) ABSTRACT

The invention relates to a method for the production of martensitic cast steel of high strength and excellent abrasion- and impact-wear resistance, intended for large parts used as anti-wear cladding in crushing and grinding mining operations, having a chemical composition, expressed in percentage by weight, of between 0.35~0.55% C, 0.60~1.30% Si, 0.60~1.40% Mn, 4.5~6.50% Cr, 0.0~0.60% Ni, 0.30~0.60% Mo, 0.0~0.70% Cu, 0.010~0.10% Al, 0.0~0.10% Ti, 0.0~0.10% Zr, 0.0~0.050% Nb, less than 0.035% P, less than 0.035% S, less than 0.030% N, optionally 0.0005~0.005% B, optionally 0.015~0.080% rare earths, and the rest being iron. The method for the production of cast steel includes smelting, pouring and heat treatment. The smelting can be performed in an electric arc furnace with acidic or basic refractory or an electric induction furnace. Smelting in an electric arc furnace as a normal operation includes melting, oxygen insufflation, blocking, refining and deoxidation. Smelting in an electric induction furnace includes melting, refining, control of nitrogen in solution and deoxidation. The heat treatment comprises hardening in forced or still air depending on the thickness of the parts, followed by a tempering heat treatment. The cast steel of the invention demonstrates excellent resistance to abrasion-/impact-wear and a suitable chemical composition balance, with the addition of microalloying agents in order to obtain high hardenability and full curing in large cast parts, typically up to 14 inches thick, with Brinell hardness preferably around 630 BHN depending on the heat treatment conditions applied.

17 Claims, 5 Drawing Sheets

METHOD FOR THE PRODUCTION OF HIGH-WEAR-RESISTANCE MARTENSITIC CAST STEEL AND STEEL WITH SAID CHARACTERISTICS

FIELD OF APPLICATION

The present invention relates to the field of wear-resistant metallic materials, especially cast steels resistant to wear by abrasion and impact for mining applications. More particularly, the present invention relates to a method for producing cast steel, by means of which a wear-resistant steel is obtained, with a predominantly martensitic microstructure and a suitable balance of chemical composition which, in conjunction with microalloying additions, makes it possible to obtain high hardenability and full hardening in large components of complex geometry used in mining applications, such as grinding, crushing and all those applications that require large components with high abrasive and impact wear resistance. In particular, the method and the steel of the present invention are used for making large components used in ball mills, concaves for crushers and covers of semi-autogenous mills, also known as SAG mills. Even more particularly, the present invention relates to a cast steel of predominantly martensitic structure, with high hardness and wear resistance under conditions of abrasion and impact, for use in the aforementioned applications.

Technical Problem

Various methods of production of steels for mining applications are known in the prior art. However, the useful life of the components obtained by these methods is unable to satisfy production requirements. In particular, the known methods do not provide martensitic steels of high abrasive and impact wear resistance and whose hardenability is sufficient to ensure high hardness throughout the cross section of components of large thickness and complex geometry fabricated with this steel, typically up to 14 inches in thickness, when they are treated by air hardening and tempering.

Solutions of the Prior Art

No methods have been identified for production of air-hardening cast martensitic steels that are able to provide an alloy with high hardness and excellent wear resistance, for use in mining applications that require large components that are subject to abrasion and impact, such as antiwear liners for grinding and crushing, such as is provided by the present invention.

In general terms, the cast steels that are usually employed in the aforementioned mining applications may be classified as: i) austenitic manganese steels of the Hadfield type; ii) Cr—Mo low-alloy steels with predominantly pearlitic microstructure; and iii) low-alloy steels with low to medium carbon content with martensitic microstructure. None of these steels effectively solves the problems mentioned above, as is explained in detail hereunder.

Austenitic manganese steels of the Hadfield type, such as those described in standard ASTM A128, possess high toughness and high capacity for hardening by cold deformation, and are mainly used in liners of ore crushing equipment. However, when the mechanical stress is not sufficient to generate a high level of hardening by cold deformation, the austenitic manganese steels inevitably display low wear resistance.

For their part, the Cr—Mo low-alloy steels with predominantly pearlitic microstructure correspond to steels with a chemical composition typically given by 0.55-0.85% C, 0.30-0.70% Si, 0.60-0.90% Mn, 0.0-0.20% Ni, 2.0-2.50% Cr, 0.30-0.50% Mo, less than 0.050% P, less than 0.050% S, which are obtained by a heat treatment of normalizing and tempering, reaching Brinell hardnesses in the range 275-400 BHN. These steels have been widely used in shells of SAG mills during the last 30 years with acceptable results, without any large changes being made.

The main limiting factor in the use of Cr—Mo low-alloy steels with predominantly pearlitic microstructure is that it is not possible to increase their wear resistance by increasing the hardness, without having an adverse effect on toughness.

Finally, another type of steel commonly used in the mining industry corresponds to low-alloy steels with low to medium carbon content with predominantly martensitic microstructure. These steels are obtained by a heat treatment of severe hardening and tempering, reaching Brinell hardnesses in the range 321-551 BHN, depending on the specific chemical composition of the alloy and on the conditions used in heat treatment. At present, these steels are widely used in concaves for crushers, shovel teeth of earth-moving equipment, discharge chutes and anti-abrasive plates, all of which are components with thicknesses typically less than 8 inches (20.3 cm). However, the main limiting factors of these steels are:

- they do not possess sufficient hardenability to guarantee constant high hardness through the cross section of a component, i.e. from the surface to the core, for components with thicknesses above 6 inches (15.2 cm); and
- the low-alloy steels with low to medium carbon content require a higher cooling rate to obtain a martensitic structure, usually employing water or oil as the quenching medium. This not only gives rise to a higher manufacturing cost, but also makes it impossible to produce large components or complex geometry with large changes of section.

Thus, although methods of production of steels for mining applications exist in the prior art, the inventors have not detected any disclosure of a method capable of producing a cast steel of the composition and microstructure specified in the present invention and which, moreover, displays the advantages that will be discussed hereunder.

As an example, document JP 2000 328180 of TAMURA Akira et al. relates to a wear-resistant cast steel of predominantly martensitic microstructure, for use in components of mills used by the cement industry, ceramic industry, etc. However, the chemical composition of this steel is substantially different from the steel obtained by the method of the present invention. The steel described in JP 2000 328180 has a chromium content preferably between 3.8 and 4.3% w/w. Moreover, said document teaches that although a chromium content greater than 5.0% w/w increases the abrasion resistance, the toughness of the steel is degraded. In contrast, the present invention describes steels with predominantly martensitic microstructure with chromium concentrations between 4.5 and 6.5% w/w, more preferably between 4.8 and 6.0% w/w, and with high hardness and excellent wear resistance in large components subjected to abrasion and impact.

Moreover, the steel described in document JP 2000 328180 does not disclose microadditions of titanium, zirconium and/or niobium, like those considered in the present invention. This document also does not disclose optional additions of boron and/or rare earths.

Conversely, Chilean patent application No. 2012-02218 of the present inventors relates to a method for the production of a cast steel of increased wear resistance with a predominantly bainitic microstructure and a suitable balance of toughness and hardness for large components in mining operations such as grinding, crushing or others that involve severe abrasion and impact, whose chemical composition, expressed in percentage by weight, comprises: 0.30-0.40% C, 0.50-1.30% Si, 0.60-1.40% Mn, 2.30-3.20% Cr, 0.0-1.00% Ni, 0.25-0.70% Mo, 0.0-0.50% Cu, 0.0-0.10% Al, 0.0-0.10% Ti, 0.0-0.10% Zr, less than 0.050% P, less than 0.050% S, less than 0.030% N, optionally less than 0.050% Nb, optionally 0.0005-0.005% B, optionally 0.015-0.080% rare earths, and residual contents of W, V, Sn, Sb, Pb and Zn less than 0.020%, and the remainder iron.

However, both the chemical composition and the microstructure of the steel obtained by the method described in application CL No. 2012-02218 are different from those described in the present application. The document of the prior art describes steels of predominantly bainitic microstructure with high wear resistance under severe abrasion and impact, and with a suitable balance of toughness and hardness, whereas the present application relates to martensitic steels with high hardness and excellent wear resistance under abrasion and impact. Moreover, the steel of CL No. 2012-02218 has a far lower chromium content than the steel disclosed in the present document.

Document WO 89/03898 of JOHANSSON, Börje, et al. discloses the use of a cast tool steel for making large forging dies for stamping steel plates for automobile bodywork. Said steel can be processed by air hardening of the complete component or can be hardened locally by flame hardening or induction hardening, also permitting the application of surface coatings by chemical vapor deposition (CVD) or nitriding to obtain a thin surface film of high hardness. In contrast to the steel obtained by the method of the present invention, which includes carbon contents between 0.35 and 0.55% w/w, the steels in the examples in WO 89/03898 have a carbon content greater than or equal to the maximum content considered by the present invention. Furthermore, said document discloses that carbon contents lower than those established therein do not allow sufficient hardness to be reached.

In addition, the steel described in document WO 89/03898 does not disclose microadditions of titanium, zirconium and/or niobium, such as those considered in the present invention.

For its part, document EP 0 648 854 of DORSCH, Carl J. et al. discloses a hot-working tool steel for use in the manufacture of injection dies for molten metal and other components of tools for hot working, and a method of manufacture thereof. Said steel is obtained by techniques of powder metallurgy and includes prealloying particles that have a sulfur content of between 0.05 and 0.30% w/w. The purpose of this invention is to provide a highly machinable steel that has an improved combination of impact toughness, machinability and high-temperature fatigue strength.

In contrast to the present application, document EP 0 648 854 describes a steel with Rockwell C hardness in the range from 35 to 50 HRC (equivalent to 327-481 HBN), whereas the steel obtained by the method of the present invention can reach hardnesses of about 630 HBN, depending on the specific characteristics of the components and the heat treatment conditions applied. Moreover, it should be emphasized that the steel of the present invention comprises lower contents of molybdenum and sulfur than those required for the steels described in EP 0 648 854.

Finally, document JP 06088167 of YUSAKU, Takano discloses a steel of high mechanical strength and heat resistance whose composition is 0.05-0.3% w/w C, less than 0.3% w/w Si, 0.1-1.5% w/w Mn, less than 1% w/w Ni, 4-6% w/w Cr, 0.05-1% w/w Mo, 0.5-3% w/w W, 0.05-0.3% w/w V, and 0.01-0.2% w/w Nb, for use in components usually exposed to high temperatures, such as gas turbines and steam turbines. Said steel is processed by hot plastic forming of ingots and billets obtained by melting and casting in a mold, followed by oil quenching from a temperature of 900-1100° C. and tempering at a temperature of 550-700° C. In contrast, the present invention does not consider a hot forming process and does not consider oil quenching.

In addition, the steel described in document JP 06 088167 has, relative to the present invention, lower contents of carbon and silicon and large additions of up to 3% w/w tungsten with the aim of producing tungsten-rich secondary precipitates that are stable at high temperature, in order to increase its creep strength. However, although document JP 06088167 specifies a chromium content similar to that of the present invention, this element is added with the primary aim of improving the resistance to oxidation and corrosion at high temperature and improve its creep strength, and not with the aim of achieving an increase in abrasive and impact wear resistance, as proposed by the present invention.

As noted above, the method of the present invention provides a steel that differs from the abrasion-resistant cast steel described in document JP 2000 328180, and from other medium-alloy and medium-carbon steels that are air hardenable and are widely used in tooling for cold or hot working, such as those described in documents WO 8903898, EP 0648854, JP 06088167, in that the invention makes use of the synergistic effect of a number of mechanisms of hardening using air hardening, which makes it possible to obtain a steel of high hardness, hardenability and excellent abrasive and impact wear resistance in large components of complex geometry.

Accordingly, the present invention provides a method for the production of martensitic cast steel that overcomes all the drawbacks mentioned above, since it possesses high hardness and excellent abrasive and impact wear resistance, for use in mining applications that require large components.

BRIEF DESCRIPTION OF THE INVENTION

The method and the steel of the present invention provide a solution to the limitations of the conventional wear-resistant steels used at present, which do not give a suitable combination of high hardness, hardenability and excellent wear resistance in components of large thickness, typically up to 14 inches (35.56 cm).

The present invention overcomes these drawbacks with a method for the production of steel that provides a martensitic cast steel of high hardness and excellent wear resistance, for mining applications, such as grinding and crushing. In particular, the present invention can be used for making components of ball mills, concaves for crushers and covers of SAG mills, among others.

One of the aims of the present invention is to provide a martensitic cast steel that has a suitable balance of chemical composition in conjunction with microalloying additions to obtain high hardenability and full hardening in castings of large size, used in mining applications that require components with high abrasive and impact wear resistance, such as grinding and crushing.

BRIEF DESCRIPTION OF THE FIGURES

For the purpose of describing the method of the present invention with greater clarity, a detailed description of the invention is given below, together with embodiment examples, which are illustrated in the accompanying figures, where.

DETAILED DESCRIPTION OF THE INVENTION

Figure 1:
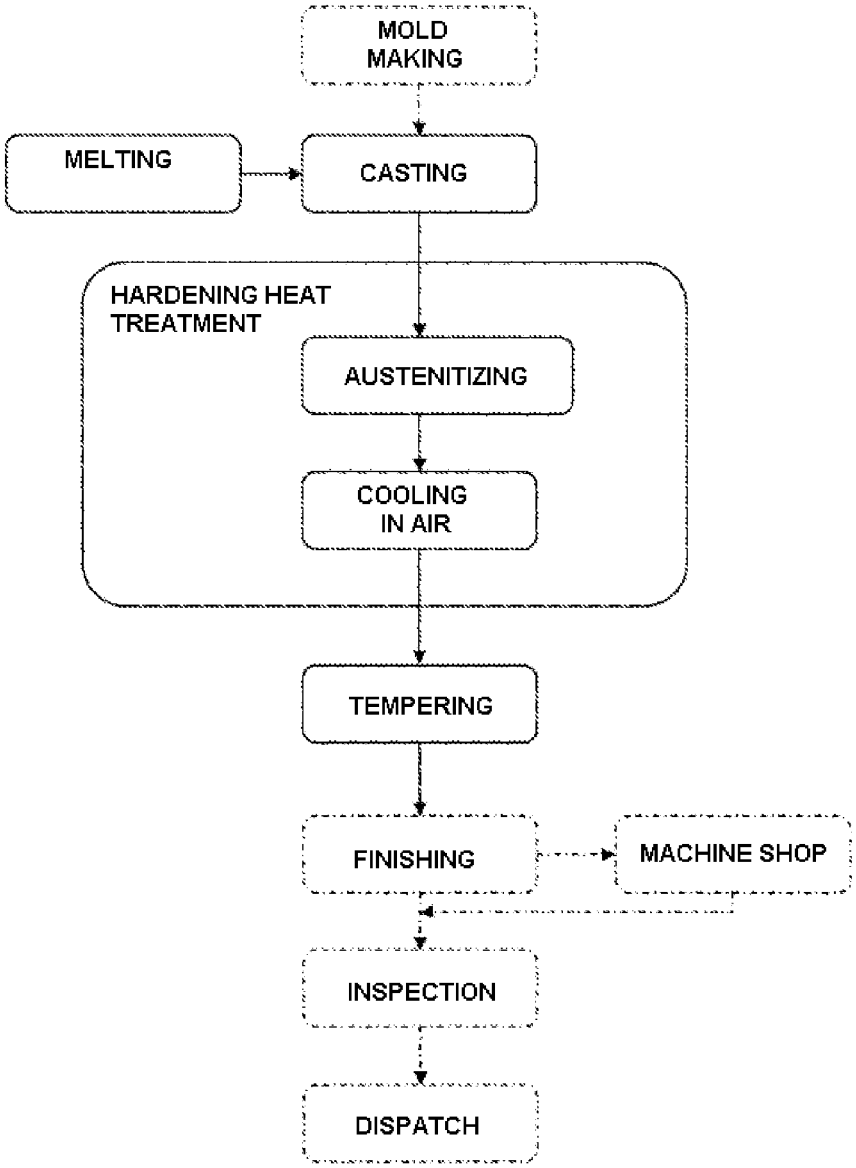
FIG. 1 is a block diagram of one embodiment of the present invention, in which the solid lines represent the main steps of the present invention.
Figure 2:
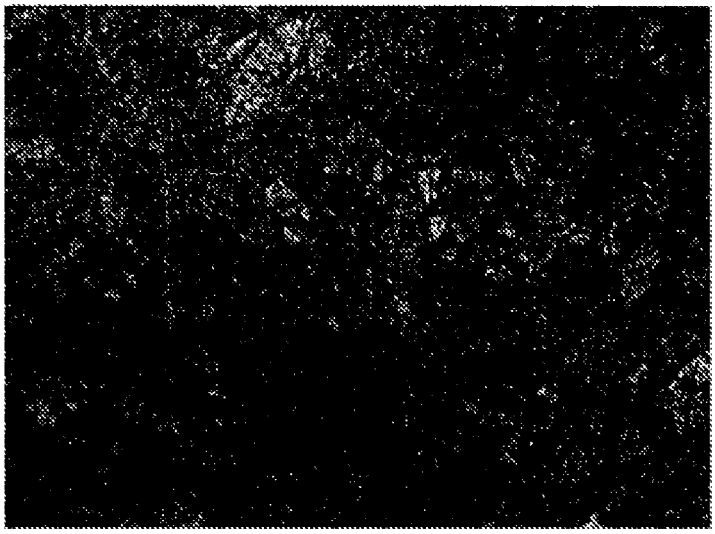
FIG. 2 illustrates the typical martensitic microstructure of the steel obtained by the method of the present invention. Reagent Nital 5%, at 400×.
Figure 3:
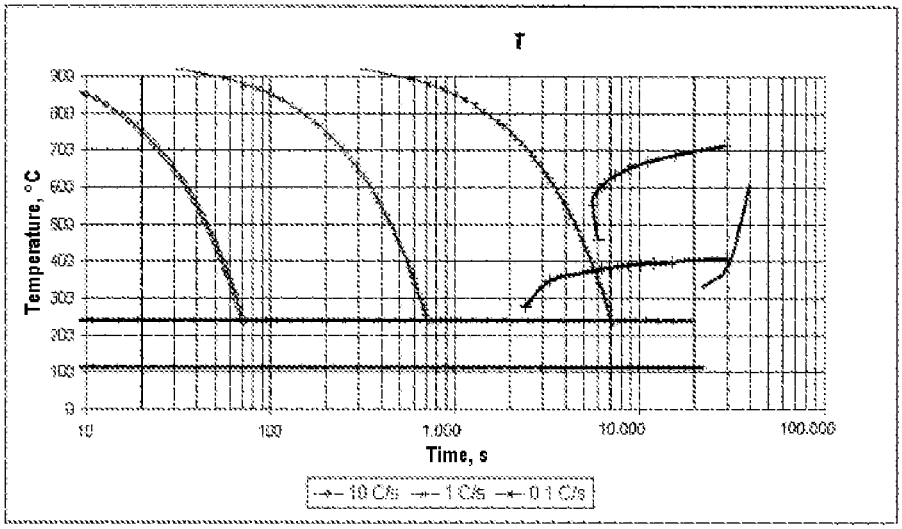
FIG. 3 corresponds to a continuous cooling transformation (CCT) diagram determined for one of the steels described in the present invention.
Figure 4:
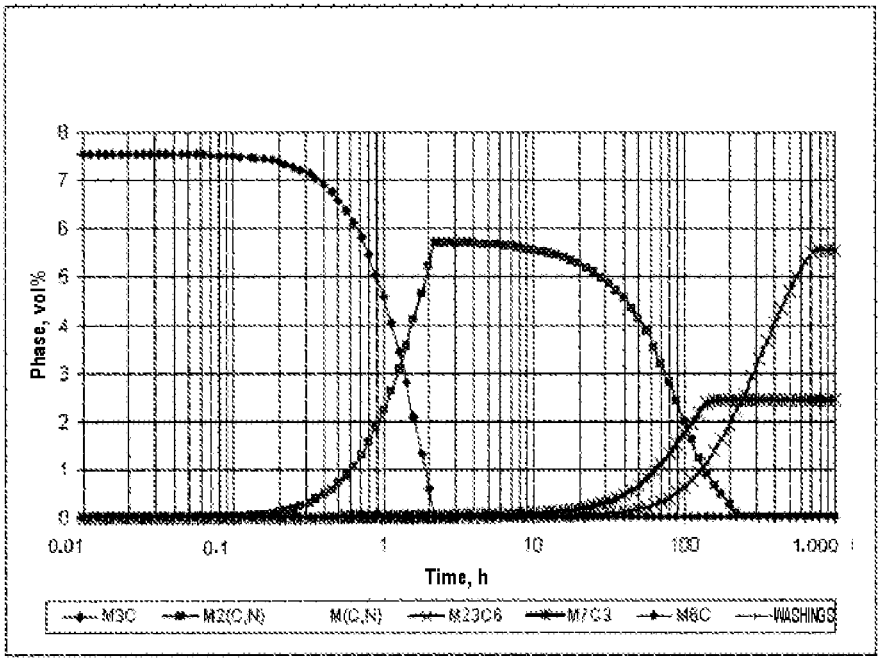
FIG. 4 is a curve describing the kinetics of precipitation of particles of second phase of one of the steels described in the invention.

One of the aims of the present invention is to provide a method for the production of martensitic cast steel with high hardness and excellent abrasive and impact wear resistance.

Another aim of the present invention is to provide a method for the production of steel with a suitable balance of chemical composition and with microalloying additions for obtaining high hardenability and full hardening in castings of large size and complex geometry.

Another aim of the present invention is to provide a cast martensitic steel with high hardness and excellent wear resistance.

Yet another aim of the present invention is to provide large steel components for mining applications, such as crushing, grinding, and all those applications that require large components with high abrasive and impact wear resistance; and a method for the production of said steel.

The method of the invention provides a martensitic steel of high hardness and excellent abrasive and impact wear resistance that has the following chemical composition:

- 0.35-0.55% w/w C, more preferably 0.35-0.50% w/w C
- 0.60-1.30% w/w Si, more preferably 0.60-1.20% Si
- 0.60-1.40% w/w Mn
- 4.5-6.50% w/w Cr, more preferably 4.8-6.0% w/w Cr
- 0.0-0.60% w/w Ni
- 0.30-0.60% w/w Mo
- 0.0-0.70% w/w Cu
- 0.010-0.10% w/w Al
- 0.0-0.10% w/w Ti
- 0.0-0.10% w/w Zr
- 0.0-0.050% w/w Nb
- Less than 0.035% w/w P
- Less than 0.035% w/w S
- Less than 0.030% w/w N
- Optionally 0.0005-0.005% w/w B
- Optionally 0.015-0.080% w/w rare earths and the remainder iron.

Preferably, in the present text, the concept "rare earths" refers to commercial mixtures of cerium, lanthanum and yttria.

Some of the basic criteria considered for limiting the chemical composition in the range described by the present invention were as follows:

- The carbon content is essential for obtaining a given steel hardness. Carbon contents under 0.35% w/w are insufficient to obtain solid solution hardening, high hardenability and hardening by precipitation of complex carbides or carbonitrides that guarantee practically constant hardness in large components with high wear resistance, whereas carbon contents above 0.55% w/w have an adverse effect on impact toughness of martensitic steels.
- Silicon increases the strength of steel by solid solution hardening of the matrix and delays the precipitation of carbides, so that it prevents a sudden decrease in hardness during tempering. However, silicon contents above 1.30% w/w have an adverse effect on the production of components of large thickness, promoting phenomena of hot cracking.
- Manganese gives a moderate increase in the hardenability of steel and refines acicular structures. However, at contents above 1.40% w/w it displays marked interdendritic chemical segregation, especially in large components.
- Chromium is an important element that provides strength, hardenability and hardening by precipitation of alloyed carbides of the type M7C3 and M23C6. The inventors concluded that chromium contents in the range 4.50-6.50% w/w Cr will produce a suitable balance of high hardness and hardenability to ensure high abrasive and impact wear resistance.
- Molybdenum is an important element that provides strength, high hardenability and secondary hardening through precipitation of carbides of the type M6C and carbonitrides of the type M(C,N) and M2(C,N). Moreover, it greatly reduces the harmful effect of impurities that segregate at grain boundaries, causing embrittlement. However, in view of its high cost, it is desirable to limit the amount added.
- Nickel increases the cohesive energy of the grain boundary, increases the toughness of the alloy and has a synergistic effect on additions of manganese and molybdenum. However, it also has a high cost and the amount added must be limited.
- Additions of titanium and zirconium, as well as having a deoxidizing effect, allow fixation of nitrogen in solid solution, control of grain size and provide hardening through precipitation of carbonitrides. Zirconium, for its part, modifies the morphology of sulfide inclusions.
- Additions of rare earths, specifically mixtures of cerium, lanthanum and yttria, have an important effect on refining the casting microstructure and on modification of the morphology of nonmetallic inclusions in the steel, which increases toughness and surface fatigue strength.
- Addition of boron greatly increases hardenability and refines the acicular phases (bainite and martensite). However, it may have an embrittling effect by combining with nitrogen and forming insoluble precipitates of BN at grain boundaries. Accordingly, the amount to be added and the sequence must be controlled in the ranges defined above.
- It has been found that appropriate use of multicomponent master alloys that contain boron, titanium, zirconium, rare earths and particular mixtures thereof, together with controlled addition of these elements, greatly improves the properties of high-wear-resistance cast steels for mining applications such as those described in this invention.

The method of production of the present invention, which provides a martensitic steel with the chemical composition detailed above, comprises the following steps:

1. Melting: may be carried out by any conventional method. For example, this operation may be carried out in an arc furnace with basic or acid refractory, or in an induction furnace.

Arc furnace melting as a normal operation comprises complete melting of the charge; followed by injection of oxygen to produce oxidation of the liquid metal; transfer of impurities to the slag and decarburization of the metal to remove nitrogen and hydrogen in solution. Then the operation of blocking of the liquid metal is carried out, to stop the oxidation; followed by the operation of refining and adjustment of the chemical composition to the specified range. Next, an operation of deoxidation is carried out using aluminum and master alloys of titanium and/or zirconium. The deoxidizing elements will be added in suitable amounts such that the residual contents of aluminum, titanium or zirconium are within the specified range for the alloy. If addition of boron and/or treatment with rare earths is required, this is performed in the ladle.

For its part, induction furnace melting as a normal operation comprises melting of the metallic charge up to a temperature not above 1700° C.; followed by adjustment of the chemical composition; followed by addition of master alloy of an element that is a strong nitride former—preferably titanium—to form a slag with high capacity for nitrogen. Then, the slag formed is removed and, next, the operation of deoxidation and pouring of the metal in the ladle is carried out.

2. Heat treatment: the operation of heat treatment comprises air hardening and tempering.

The thermal cycle of hardening comprises:

austenitizing at the hardening temperature;

holding at said temperature for a defined period of time; and then cooling in air.

Austenitizing is carried out at a temperature between 950 and 1050° C. for a variable soaking time of between 3 and 10 hours depending on the characteristic thickness and geometry of the components to be produced. Then the components are submitted to a step of air cooling to a temperature between 120 and 80° C. Cooling may be carried out indiscriminately in still air, direct forced air, indirect forced air, or a sequence of substeps thereof depending on the specific geometry of the components to be treated and the desired level of hardness. The severity of hardening of the air flow used as cooling medium must be such that the core of the components has an average cooling rate in the range 0.05-0.50° C./s, so as to ensure optimum phase distribution and hardness.

Immediately following hardening, a tempering heat treatment is carried out for a variable time of between 3 and 10 hours depending on the geometry of the component. The tempering temperature to use will depend on the desired range of hardness. If the requirement is maximum hardness and wear resistance for components subject to severe abrasion at high stress and moderate impact, the tempering temperature to use can be up to 350° C., to obtain components with Brinell hardness preferably of about 630 HEN. In the case when the mechanical stress involves a higher level of impact, the tempering temperature to use can be increased to 650° C., to obtain components with improved toughness and Brinell hardness preferably of up to 580 BHN.

Thus, the invention makes use of the synergistic effect of a number of mechanisms of hardening, making it possible, by mild hardening, to obtain a steel of high hardness, hardenability and excellent abrasive and impact wear resistance in large components of complex geometry, by:

- controlled addition of microalloying elements that are more effective than vanadium, which refine the casting microstructure and allow control of the austenite grain size and martensite packet size during heat treatment, through formation of carbonitrides of the type M(C,N);
- delaying the precipitation of cementite and promoting the precipitation of alloyed carbides during heat treatment, which produce greater hardening by precipitation of particles of second phase, preventing the occurrence of embrittlement phenomena;
- increased solid solution hardening of the martensitic matrix, with higher contents of Mn and Si, together with an optimal balance of C, Cr and Mo;
- greater hardenability, ensuring high hardness in the whole cross section in components of large thickness, typically up to 14 inches, through controlled addition of boron and substitutional elements that promote martensite formation at low cooling rates;
- generating high hardening by cold deformation during operation in service when it is subjected to repeated events of abrasion and impact, through interaction between finely dispersed precipitates and crystal defects.

EMBODIMENT EXAMPLES

Various tests of the method of the present invention were carried out, using chemical compositions within the ranges that are disclosed here.

Two steels with the compositions described in the prior art and six example steels with chemical compositions within the ranges disclosed for the present invention are compared below. All these steels underwent the method of production described in the present application.

As pointed out, the tests were carried out under the operating conditions of air hardening, at a cooling rate of 0.10° C./s. Table 1 shows the chemical compositions used in each case, expressed in % w/w.

TABLE 1

Chemical composition of steels expressed in % w/w

| Element | Steel Prior Art 1 | Steel Prior Art 2 | Example 1, Invention | Example 2, Invention | Example 3, Invention | Example 4, Invention | Example 5, Invention | Example 6, Invention |
|---|---|---|---|---|---|---|---|---|
| C | 0.35 | 0.40 | 0.36 | 0.38 | 0.38 | 0.40 | 0.42 | 0.45 |
| Si | 1.0 | 1.10 | 0.90 | 0.75 | 0.80 | 0.80 | 1.10 | 0.80 |

TABLE 1-continued

| Chemical composition of steels expressed in % w/w | | | | | | | | |
|---|---|---|---|---|---|---|---|---|
| Element | Steel Prior Art 1 | Steel Prior Art 2 | Example 1, Invention | Example 2, Invention | Example 3, Invention | Example 4, Invention | Example 5, Invention | Example 6, Invention |
| Mn | 0.80 | 0.90 | 1.0 | 0.75 | 0.90 | 0.90 | 1.15 | 0.90 |
| Cr | 5.11 | 4.0 | 5.30 | 4.90 | 5.20 | 5.20 | 5.0 | 5.20 |
| Ni | 0.0 | 0.0 | 0.50 | 0.30 | 0.30 | 0.30 | 0.35 | 0.30 |
| Mo | 1.27 | 0.30 | 0.50 | 0.50 | 0.40 | 0.50 | 0.45 | 0.50 |
| Cu | 0.0 | 0.0 | 0.10 | 0.20 | 0.20 | 0.0 | 0.30 | 0.0 |
| Al | 0.035 | 0.030 | 0.035 | 0.045 | 0.040 | 0.035 | 0.030 | 0.035 |
| Ti | 0.0 | 0.0 | 0.035 | 0.010 | 0.010 | 0.030 | 0.0 | 0.030 |
| Zr | 0.0 | 0.0 | 0.015 | 0.025 | 0.030 | 0.035 | 0.035 | 0.035 |
| N | 0.007 | 0.010 | 0.010 | 0.010 | 0.010 | 0.012 | 0.012 | 0.012 |
| B | 0.0 | 0.0 | 0.0010 | 0.0 | 0.0015 | 0.0015 | 0.0 | 0.0015 |
| Other | 0.98 V | — | 0.012 Nb | — | — | — | 0.025 Nb | — |

For its part, Table 2 shows the phase distribution and hardnesses obtained under the heat treatment conditions applied, with cooling rate corresponding to those typically occurring in components of large thickness.

TABLE 2

| Microstructure and Brinell hardness developed by the method of the present invention | | | | | | |
|---|---|---|---|---|---|---|
| | Resultant microstructure | | | | | |
| Alloy | Pearlite % | Bainite % | Martensite % | Retained austenite % | Brinell hardness | Critical quenching rate, ° C./s |
| Steel Prior Art 1 | 0.4 | 65.0 | 34.3 | 0.3 | 453 | 0.40 |
| Steel Prior Art 2 | 15.0 | 81.8 | 3.2 | 0.0 | 566 | 0.63 |
| Example 1, Invention | 0.0 | 0.0 | 97.5 | 2.5 | 584 | 0.08 |
| Example 2, Invention | 0.4 | 21.8 | 76.4 | 1.4 | 597 | 0.18 |
| Example 3, Invention | 0.0 | 0.2 | 97.6 | 2.2 | 609 | 0.03 |
| Example 4, Invention | 0.0 | 0.1 | 97.2 | 2.7 | 611 | 0.02 |
| Example 5, Invention | 0.3 | 0.5 | 95.2 | 4.0 | 610 | 0.04 |
| Example 6, Invention | 0.0 | 0.0 | 96.0 | 4.0 | 630 | 0.01 |

The critical quenching rate shown in Table 2 was obtained by constructing CCT diagrams for each alloy and corresponds to the minimum cooling rate that must be applied to obtain a microstructure free from pearlite and bainite. That is, the minimum value of the ratio of the average cooling temperature ($T_{HC}$) to the average cooling time ($t_{HC}$) for the formation of 1% bainite and 1% ferrite-pearlite, given by the formula:

$$V_i = \frac{T_{HC}}{t_{HC}} = \frac{\frac{(AC_3 + 25)}{2}}{t_{1\%\ PHASE\ i}}$$

$$V_{CRITICAL} = \min(V_{BAINITE}, V_{PEARLITE})$$

where $AC_3$ corresponds to the limit of the Ferrite/Austenite phase field under cooling.

It can be seen from Table 2 that the steels supplied by the present invention generally have a predominantly martensitic microstructure and higher Brinell hardness for relatively low cooling rates, which will make it possible to produce components of large thickness, typically of up to 14 inches (35.56 cm) in thickness, without a significant decrease in hardness toward the interior of the component and using lower cooling rates, which means a lower tendency to form cracks and a lower level of residual stresses.

However, when the method of the invention was carried out using the compositions described in the prior art, in the best case it was only possible to obtain a steel with 34% martensitic structure. Consequently, the steels with chemical compositions of the prior art obtained by the present invention have much lower hardnesses than the steels of the invention.

In addition, since hardenability is inversely proportional to the critical quenching rate, the steels described in the invention also possess greater hardenability than those described in the prior art, particularly in documents EP 0648854 (Steel Prior Art 1) and JP 2000 328180 (Steel Prior Art 2).

Figure 5:
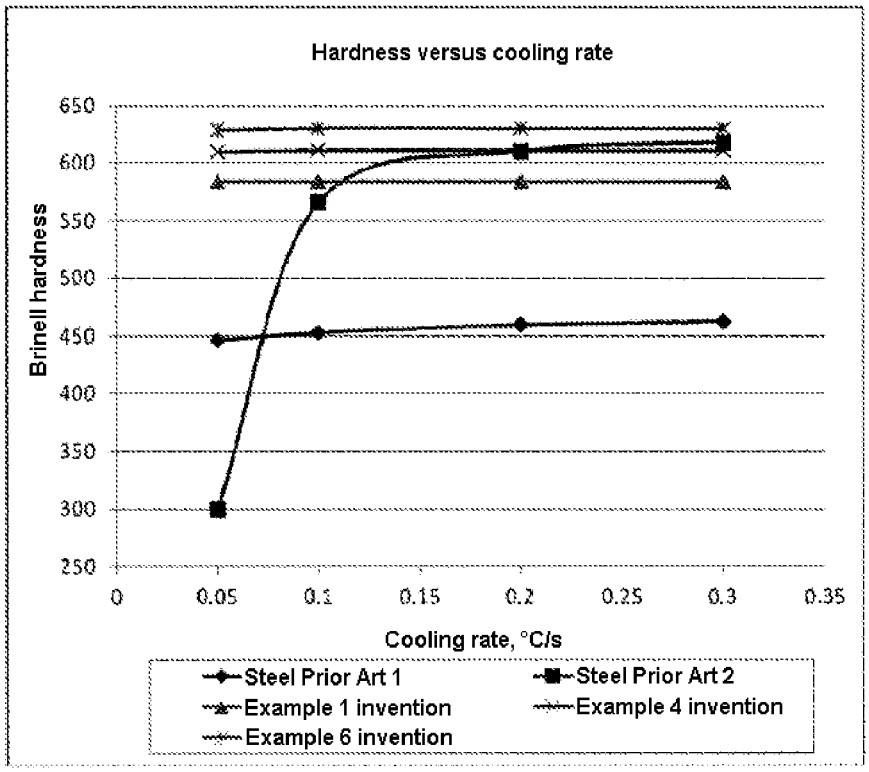
FIG. 5 is a graph of the relationship between the Brinell hardness attained by six example steels of the invention and two steels of the prior art, and the cooling rate used in the hardening heat treatment.
Figure 6:
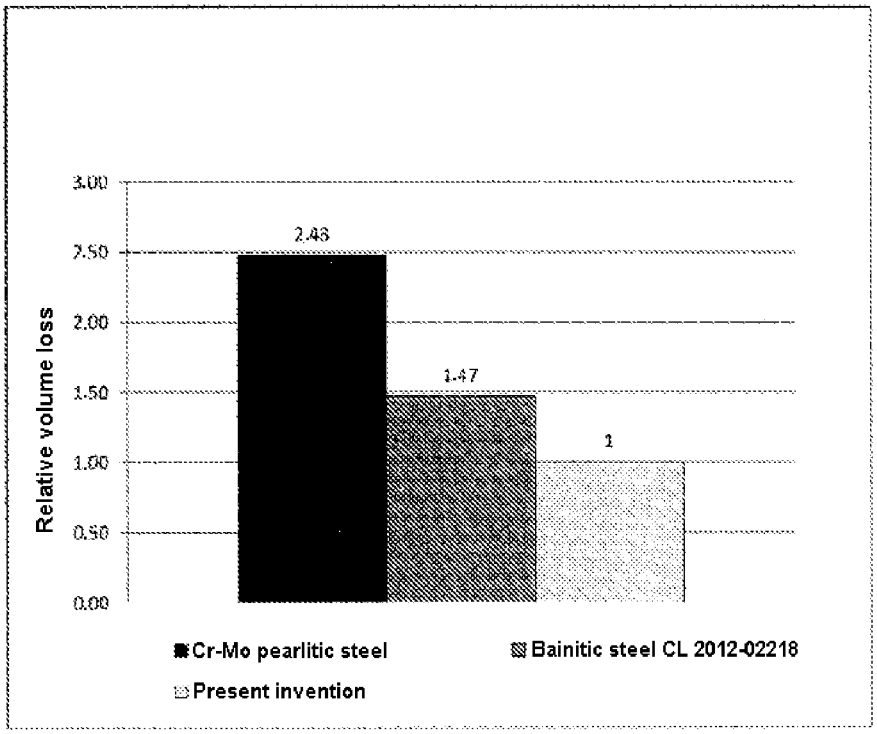
FIG. 6 is a bar chart showing the results obtained on carrying out dry abrasive wear tests according to standard ASTM G65, test method A.

The foregoing is clearly demonstrated in FIG. 5, which shows the Brinell hardnesses obtained for the two steels of the prior art and for the example steels 1, 4 and 6, when submitted to different cooling rates. It can be seen from this diagram that the steels of the present invention show greater hardness and hardenability than the steels of the prior art. In addition, it can be seen that the present invention develops a practically constant Brinell hardness regardless of the cooling rate applied during the air hardening heat treatment, which makes it possible to produce components of large thickness and complex geometry with abrupt changes in section, without any risk of cracking due to residual stresses generated by thermal gradients during cooling. Moreover, the present invention allows a predominantly martensitic microstructure to be obtained at very low cooling rates, such as occur in the core of components of large thickness when they are cooled in still air. This condition cannot be satisfied with the steels of the prior art described, as shown by FIG. 5 and the results in Table 2.

Moreover, dry abrasive wear tests were carried out according to standard ASTM G65, test method A. These tests compared the volume loss and relative wear rate of a martensitic steel defined according to the present invention, a bainitic steel described in patent application CL No. 2012-02218 and a conventional Cr—Mo pearlitic steel widely used in liners of semi-autogenous mills (SAGs).

Table 3 shown below gives the results obtained from said dry abrasive wear tests, which confirm that the martensitic steels described by the present invention possess excellent wear resistance, whereas a conventional Cr—Mo pearlitic steel displays a wear rate 2.48 times greater than the present invention and a bainitic steel described in patent application CL 2012-02218 has a 1.47 times higher wear rate. The data in Table 3 are shown in the form of a graph in FIG. 5.

TABLE 3

Abrasive wear test according to standard ASTM G65 method A

| Sample | Volume lost, $mm^3$ | Relative wear rate |
|---|---|---|
| Conventional pearlitic steel | 84.17 | 2.48 |
| Sol. in Patent CL 2012-02218 | 49.93 | 1.47 |
| Invention | 33.94 | 1.00 |

The above description presents the aims and advantages of the present invention. It is to be understood that various embodiments of this invention may be implemented and that all the subject matter disclosed herein is to be interpreted as illustrative and not in any way limiting.

The invention claimed is:

1. A method for the production of cast steel of high hardness and excellent wear resistance under conditions of abrasion and impact, with predominantly martensitic microstructure, for mining applications such as grinding, crushing and all those applications that require large components with high abrasive and impact wear resistance, characterized in that the chemical composition used, expressed in percentage by weight, comprises at least:

0.35-0.55% w/w C;
0.60-1.30% w/w Si;
0.60-1.40% w/w Mn;
4.5-6.50% w/w Cr;
0.0-0.60% w/w Ni;
0.30-0.60% w/w Mo;
0.00-0.70% w/w Cu;
0.010-0.10% w/w Al;
0.00-0.10% w/w Ti;
0.00-0.10% w/w Zr;
0.00-0.050% w/w Nb;
less than 0.035% w/w P;
less than 0.035% w/w S;
less than 0.030% w/w N;
remainder iron;

where the method comprises:

a) melting the steel of the aforementioned composition completely;

b) hardening heat treatment that comprises austenitizing at a temperature between 950 and 1050° C., for a time of between 3 and 10 hours, followed by cooling in air at a cooling rate in the range from 0.05 to 0.5° C./s, to a temperature in the range 120-80° C.;

c) tempering heat treatment at a temperature of up to 650° C., for a time of between 3 and 10 hours.

2. The method as claimed in claim 1, characterized in that the percentage by weight of carbon in the chemical composition of the steel is preferably 0.35-0.50% w/w.

3. The method as claimed in claim 1, characterized in that the percentage by weight of silicon in the chemical composition of the steel is preferably 0.60-1.20% w/w.

4. The method as claimed in claim 1, characterized in that the percentage by weight of chromium in the chemical composition of the steel is preferably 4.8-6.0% w/w.

5. The method as claimed in claim 1, characterized in that the chemical composition of the steel further comprises boron in the range 0.0005-0.005% w/w.

6. The method as claimed in claim 1, characterized in that the chemical composition of the steel further comprises rare earths in the range 0.015-0.080% w/w.

7. The method as claimed in claim 6, characterized in that the rare earths correspond to commercial mixtures of cerium, lanthanum and yttria.

8. The method as claimed in claim 1, characterized in that the melting step (a) is carried out in an arc furnace.

9. The method as claimed in claim 8, characterized in that the arc furnace has a basic refractory or an acid refractory.

10. The method as claimed in claim 1, characterized in that the melting step (a) is carried out in an induction furnace.

11. The method as claimed in claim 10, characterized in that the melting step (a) is carried out at a maximum temperature of 1700° C.

12. The method as claimed in claim 1, characterized in that the hardening heat treatment (b) is carried out by cooling in direct forced air.

13. The method as claimed in claim 1, characterized in that the hardening heat treatment (b) is carried out by cooling in indirect forced air.

14. The method as claimed in claim 1, characterized in that the hardening heat treatment (b) is carried out by cooling in still air.

15. The method as claimed in claim 1, characterized in that the hardening heat treatment (b) is carried out by a sequence of substeps in still air and/or indirect forced air and/or direct forced air in any order of precedence.

16. The method as claimed in claim 1, characterized in that the tempering heat treatment (c) is carried out at a preferred temperature of up to 350° C., obtaining components with Brinell hardness preferably of about 630 HBN.

17. The method as claimed in claim 1, characterized in that the tempering heat treatment (c) is carried out at a temperature of up to 650° C., obtaining components with Brinell hardness preferably of about 550 HBN.

* * * * *